US006382303B1

(12) United States Patent
Pavlicevic et al.

(10) Patent No.: US 6,382,303 B1
(45) Date of Patent: May 7, 2002

(54) CONTINUOUS CASTING METHOD WITH ROLLERS AND RELATIVE DEVICE

(75) Inventors: Milorad Pavlicevic, Udine (IT); Anatoly Kolesnichenko, Kiev (UA); Alfredo Poloni, Fogliano di Redipuglia; Andrea Codutti, Udine, both of (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 48 days.

(21) Appl. No.: 09/651,335

(22) Filed: Aug. 31, 2000

(30) Foreign Application Priority Data

Sep. 8, 1999 (IT) ..... UD99A0162

(51) Int. Cl.[7] ..... B22D 27/02; B22D 11/06

(52) U.S. Cl. ..... 164/471; 164/428; 164/480; 164/507

(58) Field of Search ..... 164/428, 471, 164/480, 507, 513, 468, 484

(56) References Cited

U.S. PATENT DOCUMENTS

| | | | | |
|---|---|---|---|---|
| RE16,856 E | * | 1/1928 | Gelstarp | 164/428 |
| 1,841,715 A | * | 1/1932 | Cone | 164/428 |
| 2,074,812 A | | 3/1937 | Sendzimir | 164/479 |
| 2,171,132 A | * | 8/1939 | Simons | 22/200.1 |
| 3,208,112 A | * | 9/1965 | Scribner | 22/57.5 |
| 3,823,762 A | | 7/1974 | Wondris | 164/428 |
| 5,197,534 A | | 3/1993 | Gerber et al. | 164/122.1 |
| 5,251,685 A | | 10/1993 | Praeg | 164/467 |

FOREIGN PATENT DOCUMENTS

JP 60-154865 * 8/1985

OTHER PUBLICATIONS

Patent Abstracts of Japan, vol. 008, No. 026, Feb. 3, 1984 & JP 58 184044 dated Oct. 27, 1983.
Patent Abstracts of Japan, vol. 012, No. 195, Jun. 7, 1988 & JP 63 002537 dated Jan. 7, 1988.

* cited by examiner

*Primary Examiner*—M. Alexandra Elve
*Assistant Examiner*—Len Tran
(74) *Attorney, Agent, or Firm*—Stevens, Davis, Miller & Mosher, LLP

(57) ABSTRACT

Continuous casting device and method with rollers for plane products such as strip (13) or sheet, comprising counter-rotating rollers (11) immersed in a receptacle (14) containing molten metal (15), said receptacle (14) including a bottom (114) and side walls (214), said rollers (11) being arranged parallel and adjacent to define a transit gap (12) through which the strip (13) to be produced is extracted, the device comprising holding elements (19) of the electromagnetic type arranged in cooperation with each of the ends of said rollers (11), said holding elements (19) having an inner edge, an outer edge and a curved shape suitable to surround, without contact, at least partly the surface of said rollers (11) immersed in said molten metal (15), said holding elements (19) comprising at least a coil (29) suitable to be passed through by an alternating current to generate a magnetic field in said molten metal (15) and generating currents induced therein in order to obtain the lateral confinement of said molten metal (15) in the space ("1") between the relative facing inner edges of said holding elements (19).

27 Claims, 5 Drawing Sheets

CONTINUOUS CASTING METHOD WITH ROLLERS AND RELATIVE DEVICE

FIELD OF THE INVENTION

This invention concerns a continuous casting method with rollers and the relative device, used in the field of continuous casting to cast continuous steel strip by means of a pair of rollers.

To be more exact, the invention concerns a casting method with rollers wherein magnetic type means are provided with the function of laterally containing the liquid metal, the holding means cooperating with the ends of the rollers and being suitable to partly surround the curved surfaces of the rollers.

The invention is preferably applied to continuous casting equipment with rollers where the product is extracted upwards.

BACKGROUND OF THE INVENTION

In the field of continuous casting of plane products such as strip or sheet, the state of the art includes the technique of casting with rollers, wherein the metal is unloaded onto a pair of counter-rotating and cooled rollers which define the gap through which the plane product transits and is extracted.

The state of the art also includes the provision of cooled and counter-rotating rollers partly immersed inside a receptacle, for example a tundish or similar, inside which the molten metal is fed; these rollers cause the product to be extracted upwards.

This casting technique with rollers has been subjected over the years to long and thorough studies, since it has a considerable potential to produce high quality strip and sheet, with high productivity, at a relatively low cost and using less manpower than traditional technologies. However, a plurality of problems connected to the technological process has not yet permitted a widespread development and diffusion of this technology on an industrial and commercial level, despite the good results obtained on the experimental level.

One of the main problems is the lateral containment of the molten metal in proximity or in correspondence with the ends of the rollers. Attempts to use holding means of a mechanical type have come up against the problem of finding materials which have at the same time low heat conductivity and the capacity to be rapidly heated to prevent the cooling and solidification of the steel on said holding means.

Moreover, the materials have to be highly resistant to wear caused by continuous contact with the rotating rollers.

Because of these difficulties, alternative holding systems of a magnetic type have been proposed. On the one hand, these have shown good results, since they allow to contain the metal efficiently without the limits of mechanical holding means; on the other hand, they have shown problems of overheating which impede a correct solidification of the strip in correspondence with the edges. These overheating problems mainly derive from using high frequency magnetic fields, which are moreover necessary since using low frequency magnetic fields would entail too high and unacceptable a turbulence in the metal during extraction.

Another technological problem concerning the continuous casting process with rollers is linked to the need to keep the free skin of the liquid metal (the meniscus) as flat and undisturbed as possible.

This is because variations in the surface of the meniscus affect the uniformity of the solidification, and therefore the thickness of the solidified skin of the strip, and can lead to breakages and cracks in the skin itself, particularly in the casting of steels with a high carbon content. This can lead to a poor quality of the steel produced.

A further problem is that it is impossible to translate the electromagnetic holding means along the axis of the rollers to vary the width of the strip produced.

In the light of all these problems, the present Applicant set himself the objective of finding an efficient solution which could be achieved industrially to obtain a device with rollers suitable to overcome the shortcomings of the state of the art. He has therefore devised, tested and embodied this invention.

SUMMARY OF THE INVENTION

The invention is set forth and characterized in the respective main claims, while the dependent claims describe other characteristics of the main embodiment.

The purpose of the invention is to obtain a continuous casting method and device with rollers, said device being provided with lateral containing means of an electromagnetic type for the molten metal, the containing means being configured in such a manner that they do not cause overheating problems to the edges of the strip produced and at the same time do not cause excessive turbulence in the bath; therefore they do not cause problems to the correct formation of the solidified skin.

Another purpose of the invention is to use electromagnetic lateral containing means which allow to create an air interspace between the liquid metal and the edge of said means, and thus prevent the formation of solidified skin on the walls of the means near the edges of the rollers.

A further purpose is to allow the lateral containing means to be moved, in order to regulate the width of the strip produced.

According to the invention, the continuous casting device comprises electromagnetic holding means, curved in shape, arranged in cooperation with each of the ends of the two counter-rotating rollers which define the extraction gap of the cast product.

The electromagnetic holding means are configured so as to surround, without contact, the surface of the rollers which are partly immersed in the molten metal, and are suitable to exert an action of lateral containment such as to prevent the spilling of the molten metal beyond the limit defined by their position.

According to one characteristic of the invention, the holding means are movable parallel to the axis of the casting rollers, so as to vary in a desired manner the width of the strip cast. According to another characteristic, the variation in the width of the cast strip can be obtained even without interrupting the casting process.

The electromagnetic holding means comprise at least a coil wound around a core, along which an alternating current of a desired intensity is made to circulate, suitable to generate a magnetic field.

The magnetic field is suitably concentrated towards the inner edges of the extraction gap defined between the casting rollers, and is suitable to induce in the molten metal the circulation of a secondary current having a direction opposite that of the primary current circulating in the coil.

The interaction between the secondary current and the components of the magnetic field induced by the primary current generates an electromagnetic force which prevents the spillage of the molten metal from the zone between the counter-rotating casting rollers.

According to one characteristic of the invention, the coil induces in the liquid metal a secondary current which has a particularly high density in the region near the coil itself. In this way, a high Joule effect is generated which prevents the formation of skin around the coil without preventing the creation of skin on the casting roller.

BRIEF DESCRIPTION OF THE DRAWINGS

These and other characteristics of the invention will become clear from the following description of a preferential form of embodiment, given as a non-restrictive example with reference to the attached drawings wherein.

DETAILED DESCRIPTION OF PREFERRED EMBODIMENT

Figure 1:
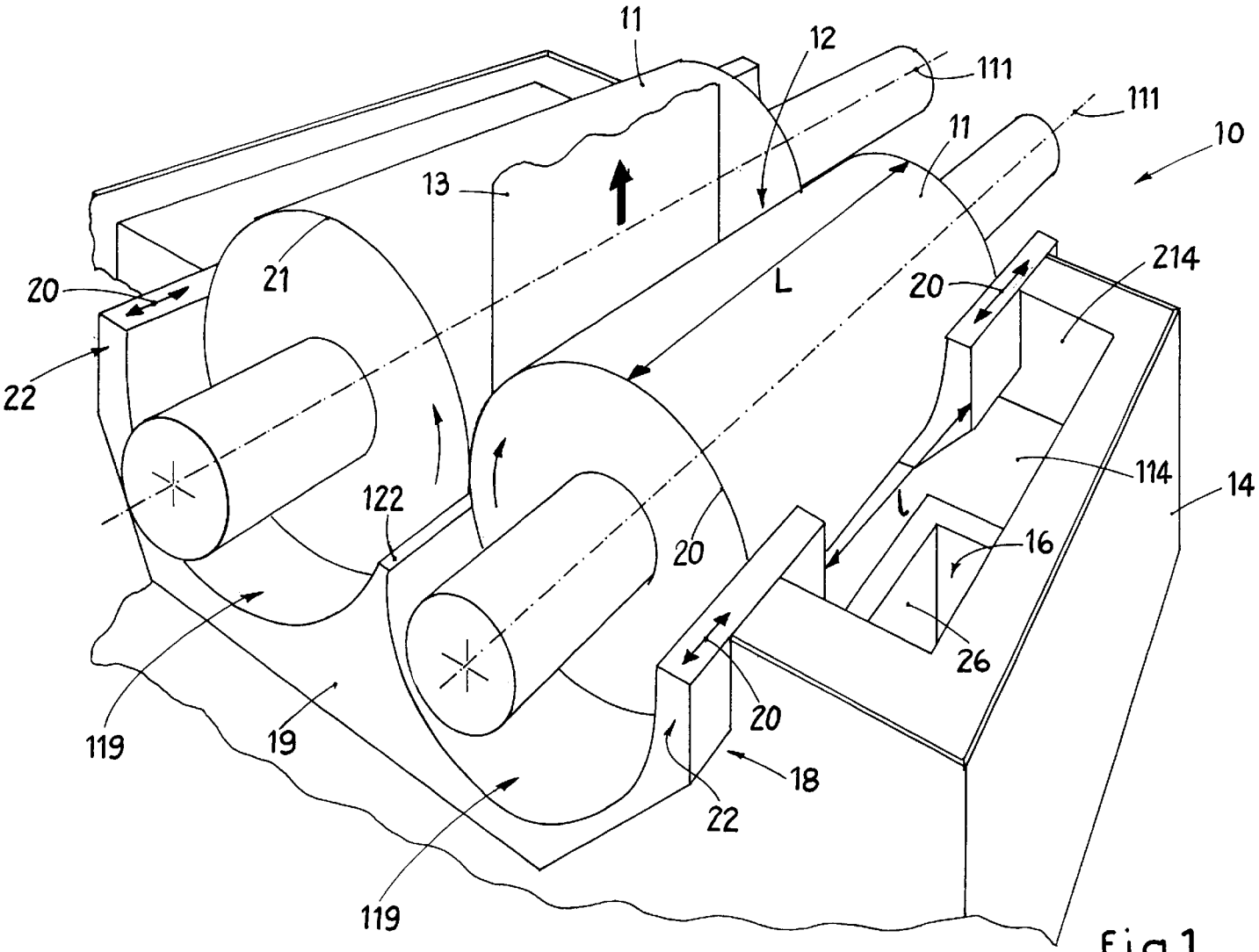
FIG. 1 is a prospective view of a continuous casting device with rollers according to the invention.
Figure 2:
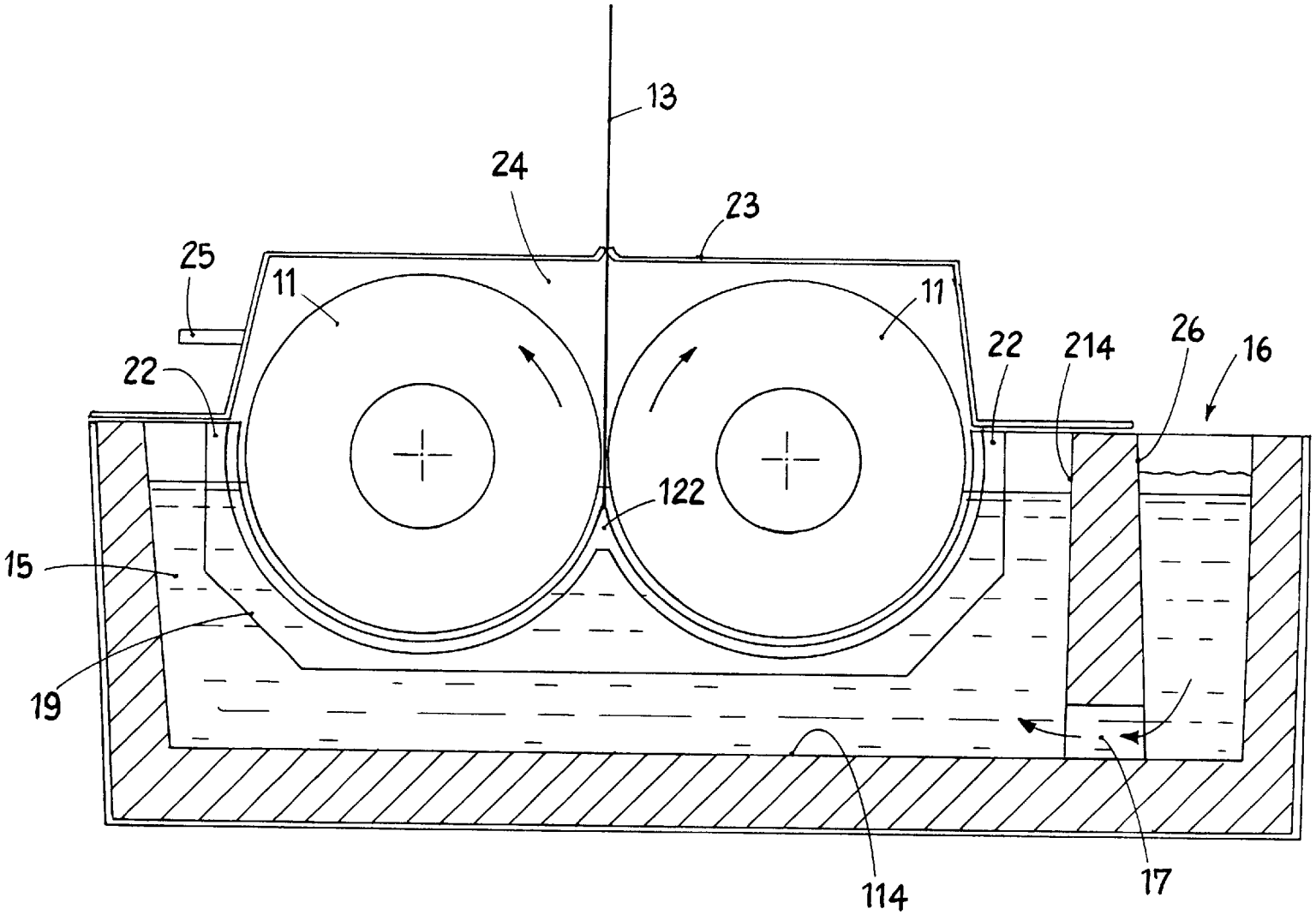
FIG. 2 is a transverse section of the device in FIG. 1.

With reference to FIGS. 1 and 2 of the attached drawings, a continuous casting device 10 with rollers is shown, comprising a pair of counter-rotating rollers 11, arranged with the respective axes 111 parallel and in an adjacent position so as to define a transit gap 12 through which the strip 13 being produced is extracted upwards.

The reciprocal distance between the axes 111 of the rollers 11 can be regulated so as to define the desired thickness of the strip 13 produced by the device 10.

Downstream of the rollers 11 there is a system to extract and possibly straighten and cool the strip 13 of a conventional type which is not shown here; the strip 13 exiting from the rollers 11 can be sent to a conventional collection system or possibly a finishing rolling step.

The device 10 also comprises a receptacle 14, suitable to contain the molten metal 15, with a bottom 114 and side walls 214.

Both the bottom 114 and the side walls 214 are advantageously made of and/or lined at least partly with refractory material and may have their surfaces treated, for example, to give an "orange peel" effect, to reduce the risks of the molten metal 15 sticking.

Inside the receptacle 14, on one side thereof, a loading zone 16 is defined, suitable to cooperate with a nozzle which is not shown here, or with another appropriate casting means, to feed the molten metal 15 to the zone below the rollers 11.

The molten metal 15 can consist of steel of any type, iron, alloys or any other suitable metal; the feed may be controlled by appropriate means suitable to guarantee that a substantially constant level is maintained inside the receptacle 14.

The loading zone 16 is separated from the containing zone of the receptacle 14 below the rollers 11 by a wall 26, so that the unloading of the molten metal 15 does not generate turbulence or agitation in correspondence with the meniscus of the metal 15, which turbulence could have a negative influence on the formation of the skin.

The molten metal 15 passes from the loading zone 16 through a transit channel 17 and goes to fill the whole volume of the receptacle 14.

In cooperation with the lateral ends of each roller 11 the continuous casting device 10 comprises lateral holding means 18 consisting of a pair of curved elements 19 mating with the shape of the rollers 11.

In this case, one holding element 19 is suitable to cooperate with both rollers 11 in correspondence with one of the ends, with a second of said holding elements 19, equal to the first, being provided at the opposite end.

It is within the spirit of the invention to provide that the holding element 19 be divided into two, substantially equal elements, each cooperating with a respective roller 11.

Each element 19 is defined by two cavities 119 inside which at least the part of the roller 11 immersed in the molten metal 15 is housed, due to having substantially the same shape.

The cavities 119 are defined by two lateral raised elements 22 and by an intermediate divider 122 which cooperates with the transit gap 12 defined between the rollers 11.

Each element 19 is positioned, with respect to the relative ends of the roller 11, so as to have a first inner segment superimposed on the surface of the roller 11 and a second outer segment protruding laterally with respect to said ends.

The reciprocal distance "1" at which the two elements 19 are positioned cooperating with the respective opposite ends of the two rollers 11 defines the width of the strip 13 which is extracted through the gap 12.

According to the invention, at least one of the elements 19, advantageously both, can be displaced in a direction 20 parallel to the axis 111 of the rollers 11 so as to vary the width of the strip 13 obtained from a small value as desired to a maximum value corresponding substantially to the length "L" of the lateral surface of the rollers 11.

In this case last, the elements 19 are translated outwards until their inner edge cooperates with the ring 21 defining the lateral surface of the rollers 11.

The rollers 11 are immersed in the molten metal 15 for a large part of their lateral surface, at an angle which advantageously is near 180°.

The holding elements 19 are positioned between the surface of the rollers 11 and the side walls 214 of the receptacle 14 so as to prevent the molten metal 15 from emerging from the receptacle 14, compromising the efficiency and productivity of the casting process and causing danger to the workers and the surrounding environment.

The rollers 11 are covered at the upper part by a screen 23 suitable to define a substantially closed chamber 24 inside which a controlled atmosphere environment is created by introducing gas through at least a feeder conduit 25. The screen 23 has a passage at the center through which the strip is extracted 13.

The device 10 functions as follows:

During the casting process, the molten metal 15 is fed from the loading zone 16, and then flows though the channel 17 until it substantially fills the whole receptacle 14 in the zone below the rollers 11.

The metal 15 in contact with the cooled surface of the rollers 11 solidifies immediately, forming a thickness of skin on each roller 11 which progressively increases in thickness.

The counter-rotating rollers 11 take the respective thicknesses of skin which have formed on their surfaces into rotation and cause them to be reciprocally joined in correspondence with the transit gap 12, and the strip 13 is obtained from this joining process.

The strip 13 is extracted from the device 10 and sent for collection or to subsequent working or finishing.

Figure 3:
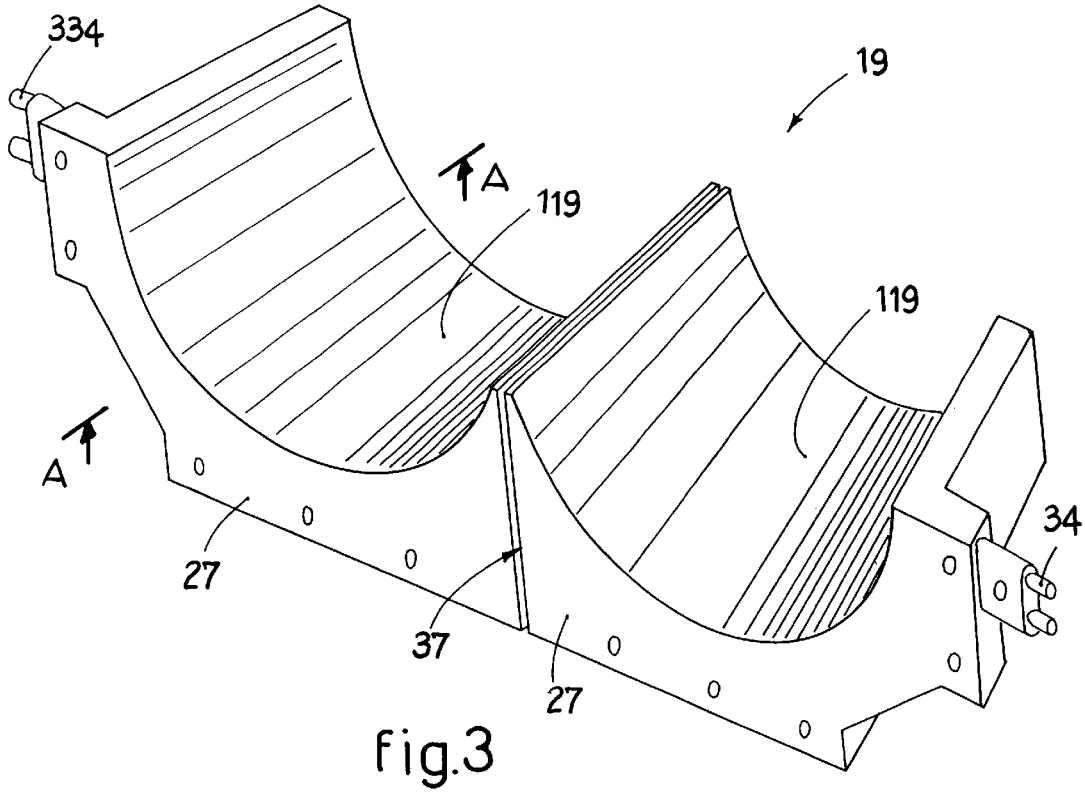
FIG. 3 is a prospective view of the holding element, associated with the rollers, containing the electromagnetic element.
Figure 4:
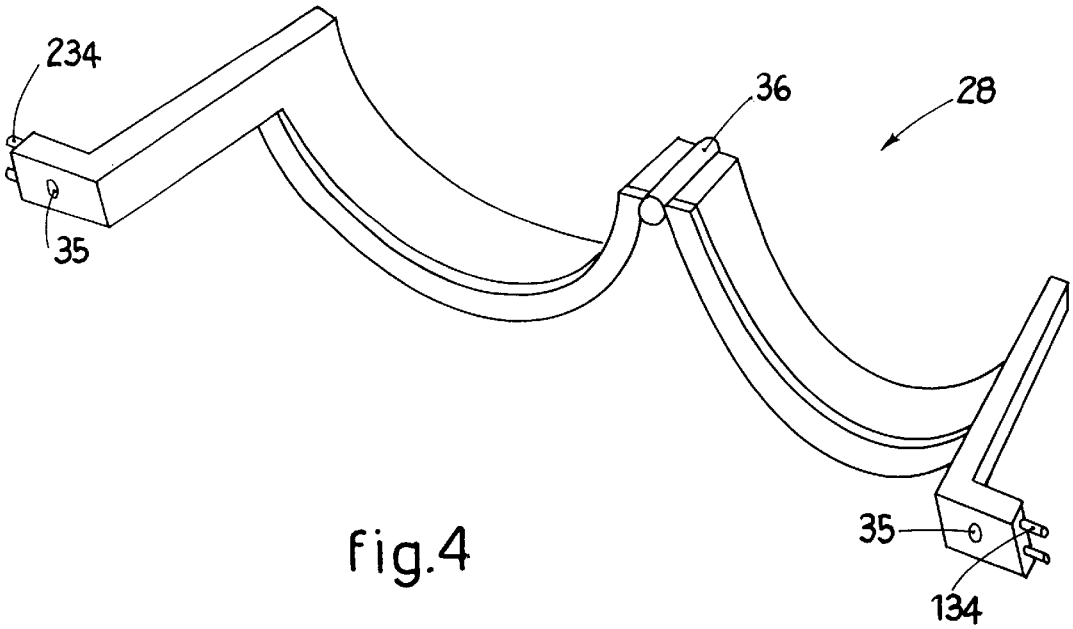
FIG. 4 is a prospective view of the electromagnetic element contained inside the holding element in FIG. 3.
Figure 5:
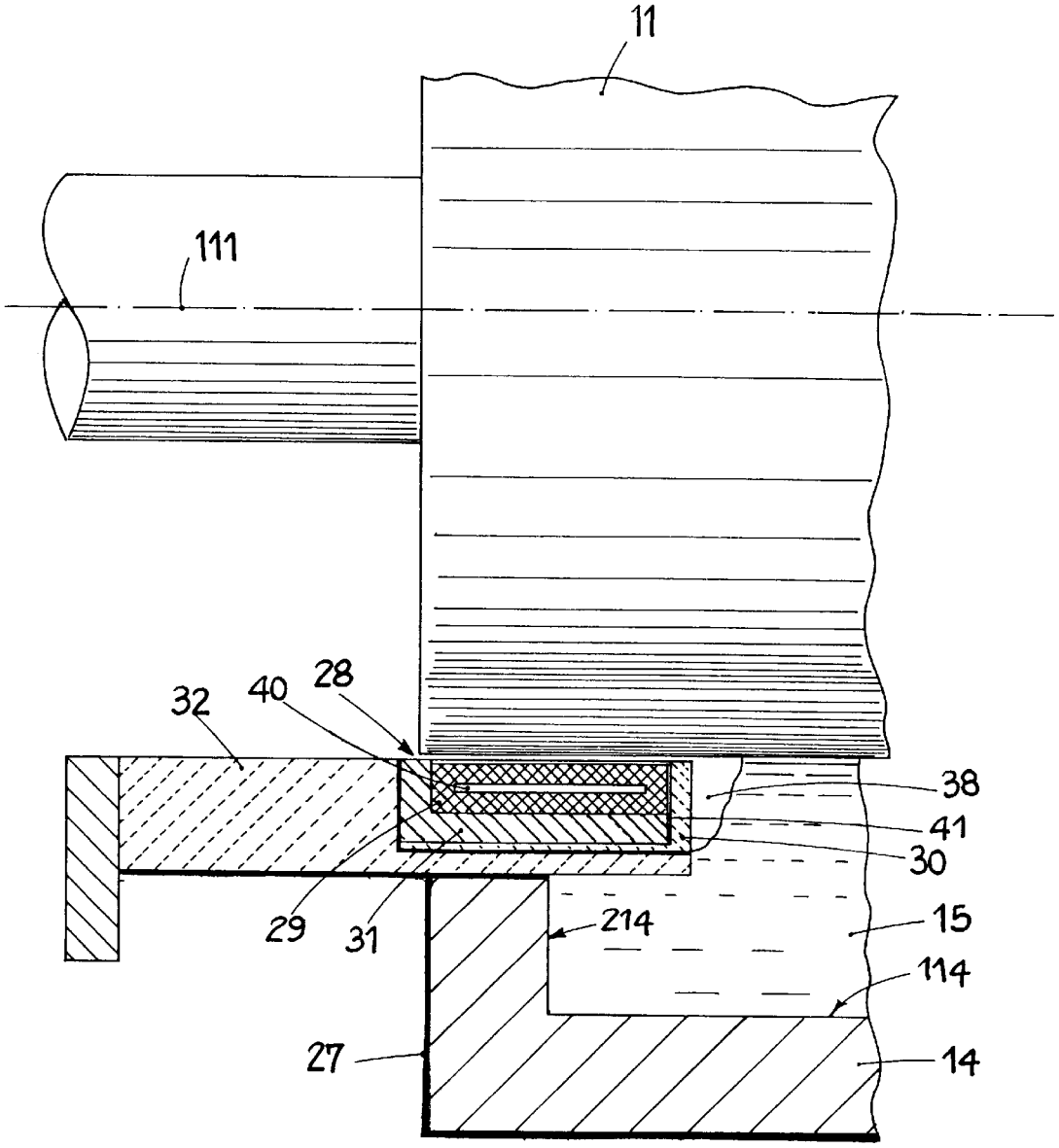
FIG. 5 shows a section from A to A of FIG. 3.
Figure 6:
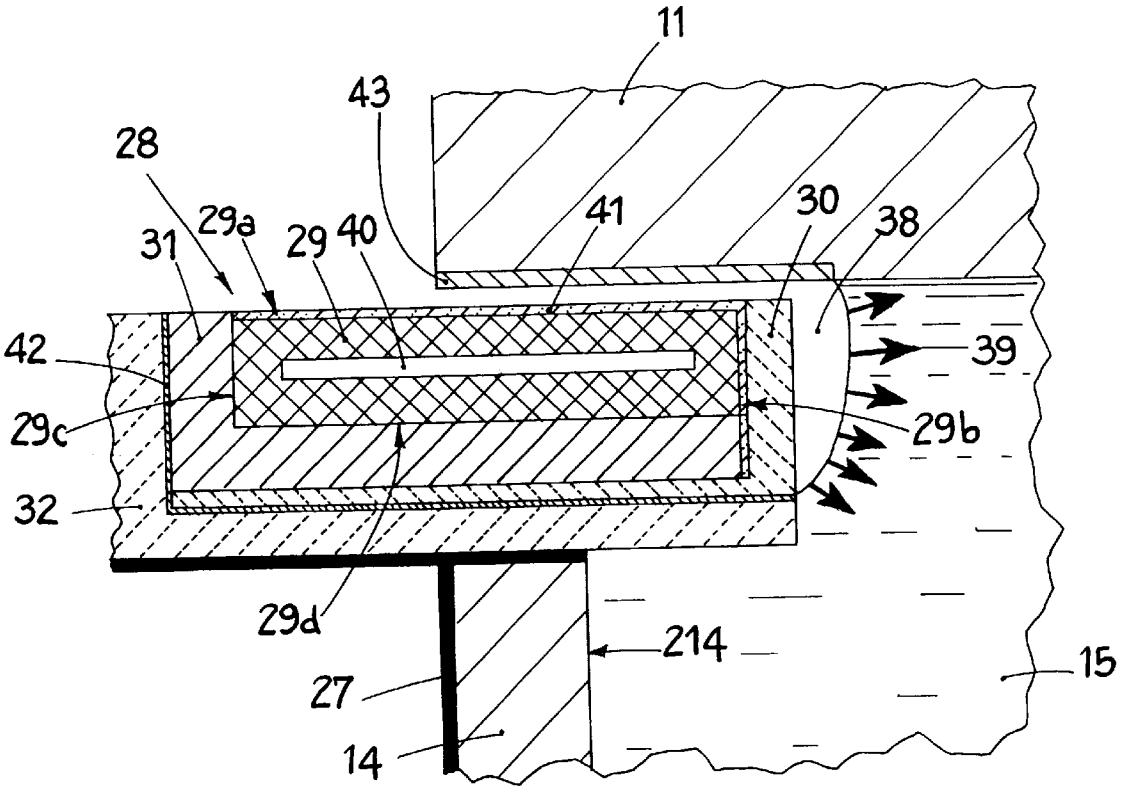
FIG. 6 is an enlarged view of FIG. 5.

A lateral holding element 19 according to the invention is shown in a prospective view in FIG. 3 and partly in longitudinal section in FIG. 5.

It comprises a containing body 27 made of stainless steel (FIG. 3) with a box-like structure, hollow inside, inside which an inductor element 28 is housed on the side facing towards the molten metal 15.

The inductor element 28 has a shaping with two cavities, symmetrical with respect to a median longitudinal axis which substantially reproduces the shape with two cavities 119 of the containing body 27.

The two parts of the inductor element 28 are connected by an at least partly elastic element 36, the function of which is to absorb the thermal dilations caused by the successive heating and cooling of the inductor 28; similarly, the two parts which constitute the containing body 27 are separated by a fissure 37 which is also suitable to compensate for any thermal dilations.

The inductor 28 is associated with cooling means, for example by water circulation.

To this end, the water is fed through first feeder conduits 34 provided in the containing body 27 and connected to second feeder conduits 134 provided in the body of the inductor 28; the water is made to emerge through first discharge conduits 234 provided in the body of the inductor 28 and connected to second discharge conduits 334 provided in the containing body 27.

The inductor 28 consists of at least a coil 29 made of a conductor metal with a single spiral, for example copper, which axially defines a hole 40 for the circulation of the cooling water.

The surfaces 29*a* and 29*b* of the coil 29, respectively that facing the lateral surface of the rollers 11 and that facing the molten metal 15, are in this case lined with a layer of insulating material 41.

The insulating material 41 can be applied with any conventional technique, although it is preferable to use the gas spray coating technique.

The other two surfaces 29*c* and 29*d* of the coil 29 are coated with a layer 31 made of ferromagnetic material with a high magnetic permeability.

The inner space of the containing body 27 around the inductor 28 is filled with hard refractory material 32, in order to limit to a minimum the heat losses from the inside to the outside of the containing body 27 and to guarantee the mechanical hold.

In the interface zone between the inductor 28 and the hard refractory material 32, and in the connection area between the coil 29 and the liquid metal 15, there is a layer of soft refractory material 30 to obtain a good heat insulation and to allow to recover any possible thermo-mechanical dilations of the coil.

The contact between the hard refractory material 32 and the soft refractory material 30 is achieved by a layer of insulating material with high magnetic permeability which achieves a sort of ferromagnetic container 42. The purpose of the container is to increase the concentration and also the gradient of magnetic flow in the cavity.

When the device 10 is working, an alternating electric current is supplied to the ends of the coil 29 through connectors 35 connected to an appropriate AC feed source (not shown here).

The alternating current passing through the coil 29 generates a magnetic flow which is absorbed, in correspondence with the surfaces of the coil, by the layer of ferromagnetic material 31 present in correspondence with the face 29*d*, by the surfaces of the rollers 11 and by the layer of refractory material 30 applied in correspondence with the face 29*b* in contact with the molten metal 15.

The magnetic flow is transmitted from the layer of refractory material 30 to the metal 15, inducing therein the formation of a secondary current, which has a direction opposite that of the primary current fed to the coil 29.

The interaction between the secondary current induced in the molten metal 15 and the components of the magnetic field generated by the primary current creates an electromagnetic force 39 directed from the coil 29 to the metal 15.

If the frequency of feed of the current to the coil 29 has a sufficiently high value, for example around 1000 Hz, the electromagnetic force 39 not only laterally contains the molten metal 15, and prevents it from spilling beyond the limits defined by the position of the inner edges of the holding elements 19: it also determines the formation of an air interspace 38 between the metal 15 and the inner edge of the coil 29.

From the above, it is clear how the continuous casting device 10 according to the invention allows to obtain the advantage of an effective electromagnetic lateral containment of the liquid metal 15, preventing it from spilling.

Moreover, since the holding means 19 are not in contact with the surface of the rollers 11, there is no deterioration of said surface, which remains flat and regular over the course of time, thus allowing to maintain a high quality of the strip produced. Furthermore, the configuration and structure of the holding elements 19, mating with the shape of the rollers 11, allows them to be easily displaced in a direction parallel to the axis 111 of the rollers 11, so that it is possible to adjust the width of the strip 13 produced even without interrupting the casting process.

Each of the final parts of the rollers 11 can be provided with a thin ring 43 made of ferromagnetic material in order to further concentrate the electromagnetic forces on the molten material 15 in the zone between the roller 11 and the inductor 28.

Figure 7:
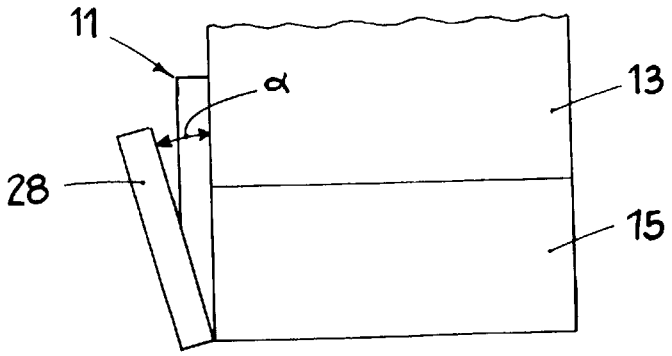
FIG. 7 is a schematic side view of a detail of the device in FIG. 1.

In this case, as shown in the detail in FIG. 7, the inductor element 28 is arranged on a plane inclined by an angle $\alpha$ with respect to the vertical defined substantially by the plane on which the strip 13 lies. According to the invention, the angle $\alpha$ is between 1° and 6°, advantageously between 1° and 3°.

The angle of inclination $\alpha$ serves to compensate the variations in the ferrostatic pressure exerted by the liquid metal 15 on the surfaces of the rollers 11.

In fact, with the casting configuration as shown above, the head of the liquid metal 15 varies along the circumference of the roller 11, causing mating variations in the ferrostatic pressure.

The inductor 28, however, exerts a uniform electromagnetic force which depends on the current circulating in the coil 29.

Therefore the gap 38 which is created will be at its maximum in the zone where the electromagnetic force 39 has to contrast a minimum ferrostatic pressure, and vice versa.

This is not a good situation, since it could cause problems in the formation of the skin, which in fact is not to be found at every moment in an equidistant position from the inductor.

In the zone of maximum ferrostatic pressure, the skin in fact is to be found rather near the inductor, and is therefore subject to a more intense Joule effect which could even cause it to re-melt.

It is possible to correct this problem by correctly inclining the inductor element 28 as shown in FIG. 7 in a manner correlated to the development of the ferrostatic pressure, distancing the inductor 28 where the ferrostatic pressure is minimal and keeping it near where the pressure is at its maximum.

In fact, since the electromagnetic force 39 produced in the liquid metal 15 by the inductor element 28 decreases with the distance therefrom, it is possible to obtain a distribution of force on the liquid metal which is not constant.

If the inductor element 28 is correctly inclined, this distribution of force allows to contrast the ferrostatic pressure uniformly, creating in this way a uniform interspace 38 along the circumference of the roller 11.

It is obvious that modifications and additions can be made to this invention, but these shall remain within the field and scope thereof.

It is also obvious that, although the invention has been described with reference to a specific example, a skilled person in the field shall be able to achieve many other equivalent forms of a continuous casting device with rollers, but these shall all come within the field and scope of this invention.

What is claimed is:

1. A continuous casting method with rollers for plane product by means of a device comprising counter-rotating rollers (11) partly immersed in a receptacle (14) containing molten metal (15), said receptacle (14) including a bottom (114) and sidewalls (214), said rollers (11) being arranged parallel and adjacent to define a transit gap (12) through which the plane product to be produced is extracted, comprising the steps of:

positioning electromagnetic holding and lateral containment means (19) in cooperation with each of the ends of said two rollers (11), said electromagnetic holding and lateral containment means (19) being arranged in such a manner as to surround, without contact, at least partly the surface of said rollers (11) immersed in said molten metal (15), said electromagnetic holding and lateral containment means (19) being arranged in an intermediate position between said surface of the rollers (11) and said side wall (214) of receptacle (14), wherein said electromagnetic holding and lateral containment means are movable parallel to the axis of said casting rollers, feeding an alternating current to at least a coil (29) made of conductor material arranged inside said electromagnetic holding and lateral containment means (19), said coil (29) including at least a surface **(29*a*) facing towards said surface of said rollers (11) and a surface (29*b*) facing towards said molten metal (15), said alternating current causing the formation of electromagnetic forces (39) directed from said coil (29) to said molten metal (15) and suitable to laterally confine said molten metal (15) in the space between the inner edges of said holding means (19)**.

2. The method as in claim 1, wherein said holding means (19) is laterally displaced in a direction (20) parallel to the axis (111) of said rollers (11) to vary the width of the plane product produced.

3. The method as in claim 2, wherein said electromagnetic holding and lateral containment means provide lateral displacement without interrupting the casting process.

4. The method as in claim 1, wherein comprising varying the distance between said rollers (11) to vary as desired the thickness of said plane product.

5. A continuous casting device with rollers for plane product, comprising:

a receptacle (14) for containing molten metal (15), counter-rotating rollers (11) having ends and partly immersed in the receptacle (14) for containing molten metal (15), said receptacle (14) including a bottom (114) and side walls (214), said rollers (11) being arranged parallel and adjacent to define a transit gap (12) through which the plane product to be produced is extracted, electromagnetic holding elements (19) arranged in cooperation with each of the ends of said rollers (11), said holding elements (19) having an inner edge, an outer edge and a curved shape suitable to surround, without contact, at least partly the surface of said rollers (11) when immersed in said molten metal (15), said holding elements (19) comprising at least a coil (29) for passing an alternating current therethrough to generate a magnetic field in said molten metal (15) and generating currents induced therein to obtain the lateral confinement of said molten metal (15) in the space ("1") between the relative facing inner edges of said holding elements wherein said electromagnetic holding element are movable parallel to the axis of said casting rollers.

6. The device as in claim 5, wherein said holding elements (19) are defined by cavities (119), mating in shape with the shape of the relative roller (11), separated by an intermediate divider (122) cooperating with said transit gap (12) defined between said two rollers (11).

7. The device as in claim 5, wherein said holding elements (19) include at least a position wherein they are arranged with a first inner segment superimposed on the surface of the relative roller (11) and a second outer segment protruding laterally with respect to the end of said roller (11), and at least a second limit position wherein they have said inner edge substantially cooperating with a ring (21) defining the end of said relative roller (11).

8. The device as in claim 6, wherein each holding element (19) comprises a containing body (27) with a boxlike structure, hollow inside and curved in shape defining said cavities (119), inside which, on the side facing towards the molten metal (15), an inductor element (28) comprising said coil (29) is housed.

9. The device as in claim 8, wherein said inductor element (28) has a shaping with two cavities symmetrical with respect to a median longitudinal axis substantially reproducing the shape with cavities (119) of said containing body (27).

10. The device as in claim 9, wherein said inductor element (28) includes an at least partly elastic element (36) arranged in an intermediate position between said two symmetrical cavities and suitable to absorb the heat dilations caused by the successive heating and cooling of said inductor (28).

11. The device as in claim 8, wherein said containing body (27) has a fissure (37) separating said two cavities (119) suitable to compensate the thermal dilations.

12. The device as in claim 9, wherein said inductor element (28) is associated with means to feed (134) and discharge (234) cooling water.

13. The device as in claim 5, wherein said coil (29) comprises at least a spiral, has a conformation axially defining a hole (40) for the transit of cooling water and has at least one surface (29*a*) facing towards the surface of the relative roller (11), at least one surface (29*b*) for facing towards the molten metal (15) and two surfaces (29*c*, 29*d*) facing towards said containing body (27).

14. The device as in claim 13, wherein said surfaces (29*a*, 29*b*) are lined with insulating material (41).

15. The device as in claim 13, wherein said surfaces (29*a*, 29*b*) are lined with ferromagnetic material (31) with high magnetic permeability.

16. The device as in claim 8, comprising hard refractory material (32) arranged to fill the inner space between the inductor (28) and the containing body (27).

17. The device as in claim 16, wherein it comprises soft refractory material (30) arranged in the interface zone between said inductor (28) and said hard refractory material (32) and in the connection zone between said coil (29) and said liquid metal (15).

18. The device as in claim 16, wherein in the connection zone between said hard refractory material (32) and said soft refractory material (30) there is a layer of insulating material with high magnetic permeability suitable to achieve a ferromagnetic container (42) with the function of increasing the concentration and the gradient of the magnetic flow.

19. The device as in claim 5, wherein said receptacle comprises, on one side, a loading zone (16) for loading the molten metal (15) suitable to cooperate with casting means, said loading zone (16) being separated from the containing zone of said receptacle (14) under said rollers (11) by at least a wall (26) and being connected to said containing zone by at least a channel (17).

20. The device as in claim 8, wherein said inductor element (28) is arranged inclined by an angle ("$\alpha$") with respect to the vertical defined by the plane on which said strip (13) lies, for contrasting in a uniform manner variable value ferrostatic pressure which the molten metal (15) generates on the surface of said rollers (11), and for creating a uniform air interspace (38) along the circumference of said rollers (11).

21. The device as in claim 20, wherein said angle ("$\alpha$") is between 1° and 6°.

22. The device as in claim 5, comprising screening means (23) suitable to define a substantially closed chamber (24) around said rollers (11).

23. The device as in claim 22, comprising means (25) to introduce gas inside said chamber (24) to create a controlled atmosphere environment.

24. The device as in claim 22, wherein said screening means (23), in a substantially central position, comprise a passage through which said planar product is extracted.

25. The method as in claim 1, wherein the method comprises making the plane product as a member of the group consisting of a strip (13) and sheet.

26. The device as in claim 5, wherein the plane product is a member of the group consisting of a strip (13) and sheet.

27. The device as in claim 20, wherein said angle ("$\alpha$") is between 1° and 3°.

* * * * *